US006367208B1

(12) United States Patent
Campbell et al.

(10) Patent No.: US 6,367,208 B1
(45) Date of Patent: Apr. 9, 2002

(54) COMPOSITE FOUNDATION POST

(76) Inventors: Jerome Campbell, 1269 County Rd., 158, Heflin, AL (US) 36264; David Hubbell, 112 Park Ave., Saranac Lake, NY (US) 12983

( * ) Notice: Subject to any disclaimer, the term of this patent is extended or adjusted under 35 U.S.C. 154(b) by 0 days.

(21) Appl. No.: 09/479,471

(22) Filed: Jan. 10, 2000

(51) Int. Cl.[7] ..... E02D 27/42

(52) U.S. Cl. ..... 52/169.13; 52/170; 52/301; 52/309.16; 52/721.2; 52/736.1

(58) Field of Search ..... 52/158, 169.13, 52/170, 300, 301, 309.16, 721.2, 736.1, DIG. 8, DIG. 9, DIG. 7; 256/13.1, 19; 248/156, 545, 530; 40/606, 607

(56) References Cited

U.S. PATENT DOCUMENTS

| | | | | | |
|---|---|---|---|---|---|
| 712,394 | A | * | 10/1902 | Lincoln | 52/170 |
| 1,542,498 | A | * | 6/1925 | Gardiner | 52/155 |
| 1,824,578 | A | * | 9/1931 | Thake | 40/607 |
| 3,378,967 | A | * | 4/1968 | Baumeister | 52/155 |
| 4,063,713 | A | | 12/1977 | Anolick et al. | 256/13.1 |
| 4,795,666 | A | * | 1/1989 | Okada et al. | 428/71 |
| 5,152,507 | A | | 10/1992 | Lee | 256/13.1 |
| 5,219,241 | A | | 6/1993 | Picton | 404/6 |
| 5,336,016 | A | | 8/1994 | Baatz | 404/6 |
| 5,403,112 | A | | 4/1995 | Carney, III | 404/6 |
| 5,507,473 | A | | 4/1996 | Hammer et al. | 256/13.1 |

FOREIGN PATENT DOCUMENTS

| | | |
|---|---|---|
| WO | WO 99/61708 | 12/1999 |

* cited by examiner

*Primary Examiner*—Beth A. Stephan
*Assistant Examiner*—N. Slack
(74) *Attorney, Agent, or Firm*—Hamilton, Brook, Smith & Reynolds, P.C.

(57) ABSTRACT

An efficient structural composite suitable for a cantilever applications in nonomnidirectional uses, such as that of highway guardrail posts, assembled from recycled plastic or rubber material as compressive elements with embedded formed sheet steel as tensile elements and shear transfer by encapsulation of said tensile elements in said compressive elements. Structural integrity and/or specific maximum service loads can be achieved through design sizing of shear-transfer elements allowing for intended catastrophic structural failure, which is useful in highway guardrail system design.

15 Claims, 5 Drawing Sheets

COMPOSITE FOUNDATION POST

BACKGROUND OF THE INVENTION

Foundation posts for highway safety guardrails are typically made of wood or steel, both of which are relatively inexpensive, readily available, and sufficiently strong to support the guardrail.

Recycled plastics are currently in wide use as a compressive structural member "spacer-block" component between a guardrail and post. The plastic spacer block is used as a substitute for the traditional wood or steel spacer block in W-beam highway-roadside guardrail systems. While the concept of using plastics as guard rail post components has been disclosed, plastics generally have not been selected for use in guardrail posts due in part to five structural considerations.

First, the most widely used highway guardrail system is the "strong-post" design. Strong-post guardrail systems resist impacting vehicles in a rigid-manner providing little deflection of the support posts. The standard guardrail posts presently used are 6" by 8" timber or 6" wide-flange steel beams. Both the wood post and the steel post carry the lateral design loadings with very little deflection vis-á-vis plastic matrix posts of similar dimensions.

Second, the most widely used guardrail installation method is the "drop-hammer." The typical truck-mounted guardrail post-driver is a gravity-dead-weight which is dropped on the top of an individual post driving the post into the soil. The post is driven by successive blows of the drop-hammer to the depth desired. Unlike typical foundation pile driving, the guardrail post must be driven to a specific depth as the W-beam rail must be at a specific height above the road surface. Posts in current use that are formed of wood or steel have significant rigidity under the impact of the drop-hammer allowing for transmission of the vertical applied force through the post to the soil matrix. Due to plastic's significantly higher elasticity, the use of a drop-hammer is impaired as the vertical applied force is dissipated due to the rubbery nature of plastic.

Third, plastics tend to have lower overall tensile and compressive strengths vis-á-vis steel. Plastics when dimensioned to that of wood posts still remain inferior in tensile strength. As such, to meet the strength requirements of the standard "strong-post" guardrail post, the dimensional size exceeds the maximum allowable for the typical installation-equipment of the present art.

Fourth, the standard "strong-post" guardrail system requires the use of a "post-bolt" (sometimes known as the "thru-bolt"). The post-bolt is passed through the W-beam rail component, then the spacer-block and finally, through the post. That is, the head of the post-bolt is in contact with the traffic-side of the rail-section and the threaded end of the post-bolt is on the "away-side" of the system's post. At issue is the incompatibility of a plastic post and the standard steel post-bolt. When the strong-post guardrail is impacted by a crashing vehicle, the W-beam rail and spacer-block and post are usually subjected to torque. The rail, spacer-block, post system resists the applied torque by way of the post-bolt. Due to significant "hardness" differential vis-á-vis a steel post-bolt and a plastic post, the steel post-bolt tends to knife or cut through the plastic post.

Fifth, a plastic guardrail post, of dimensional size suitable for use with the state-of-the-art installation-equipment, provides significantly less resistance to torque loads due to impacting crashing vehicles.

In one disclosure (U.S. Pat. No. 5,507,473, issued to Hammer et al.), plastic guardrail posts are strengthened by providing a reinforcing member in the plastic extending along a neutral axis of the guardrail post.

SUMMARY OF THE INVENTION

The present invention relates to and addresses concerns inherent to plastics virgin and/or recycled) and/or rubber (virgin and/or recycled) and its use as a structural post component, particularly for highway safety guardrails.

A composite foundation post of this invention includes a reinforcement in or attached to the tensile region of a polymer matrix. Preferably, the post is a highway guardrail post, and the reinforcement includes perforated U-channel sheet steel.

In a method of the invention, a drive cap is positioned on the post before the post is driven into a support matrix (e.g., soil).

The present invention offers a number of advantages. The use of reinforcement in the tensile region of the post remedies the lack of tensile strength in the polymer matrix. The use of one or more perforated steel U-channel beams in a highway guardrail post of this invention also imparts strength perpendicular to the run-of-rail but allows the post to shear off if a tire, for example, snags on a post, which would otherwise bring the vehicle and its passenger to a catastrophic stop. Posts of this invention also strongly resist torque so as to minimize "pocketing" of the guardrail system when impacted between posts. Further, the polymer matrix can be formed from recycled plastics thereby reducing waste, disposal costs and environmental damage. Moreover, methods of this invention allow the plastic composite post to be driven into the ground without shredding the plastic.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

A foundation post (or pile; these terms are used interchangeably herein) of this invention is formed of a polymer matrix and a reinforcement material extending through a tensile region (i.e., the region of the post that is in tension when a designed-for lateral load is applied) of the foundation post. The polymer matrix can be plastic (virgin and/or recycled) and/or rubber (virgin and/or recycled). Preferably, the polymer comprises polyethylene from recycled wire housings, as described in U.S. Pat. No. 5,951,712 issued Sep. 14, 1999, which is incorporated herein by reference in its entirety. The reinforcement can be, for example, sheet steel, or fiber (cloth or strands), such as fiberglass or carbon fiber. The sheet steel is preferably in the form of one or more thin, galvanized, perforated U-channel steel sheet(s). In further preferred embodiments, the post is formed by casting the polymer in a mold with the reinforcement positioned in the mold so as to be in the post's tensile region. Where the foundation post is for a highway guardrail, the post is configured using pre-approved U.S. Transportation Department components and U.S. Federal Highway Administration required crash-tested sub-systems. In particular, the U-channel steel sheets act as break-away devices conforming with regulations set forth in National Cooperative Highway Research Program Report 350.

Figures 1, 2:
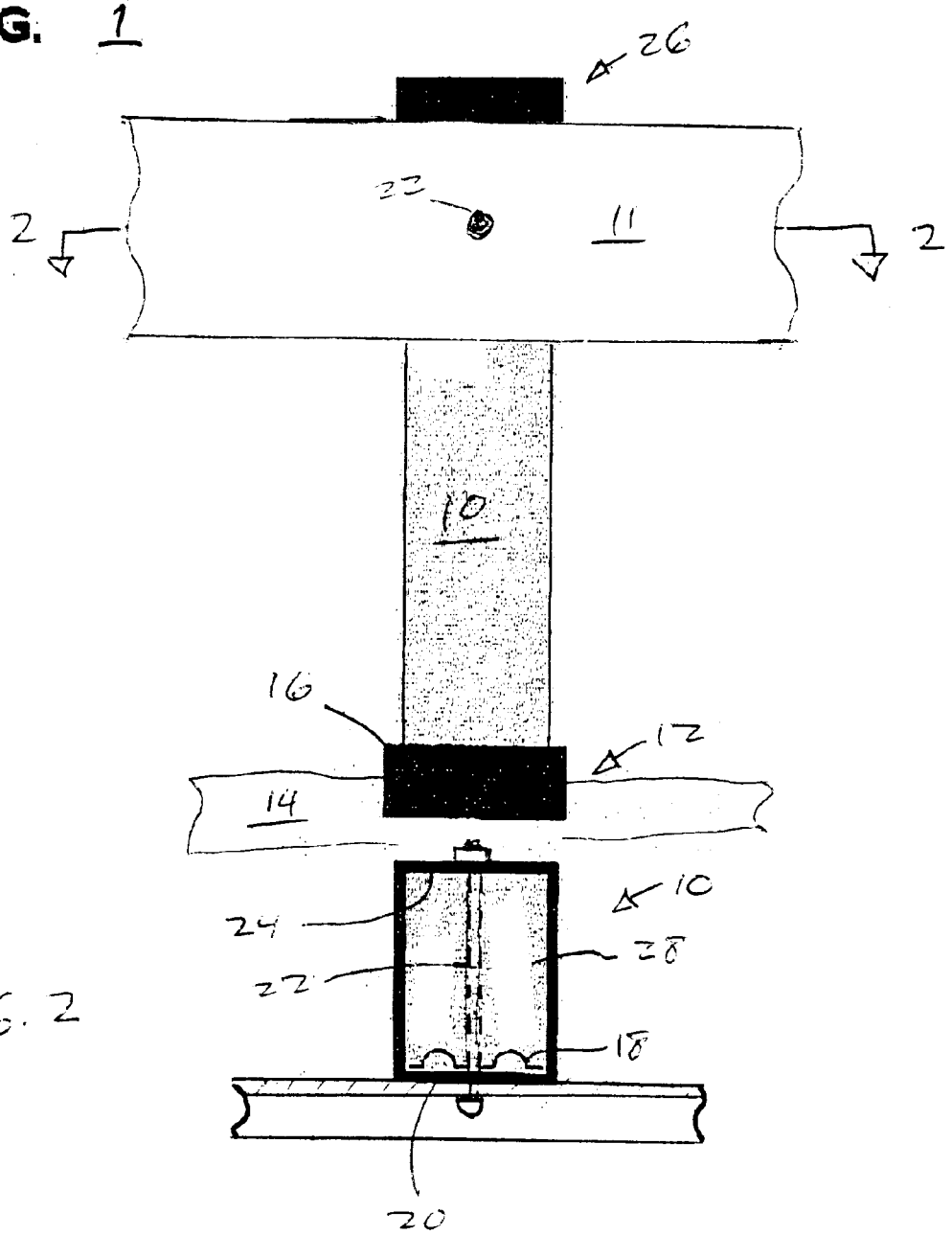
FIG. 1 is a view of a foundation post of this invention with a guardrail attached.
FIG. 2 is a cross-sectional, downward view of the post and guardrail shown in FIG. 1.

A preferred embodiment of a foundation post 10 of this invention connected to a guardrail 11 is illustrated from a front view (facing the tensile face of the pile) in FIG. 1. In addition to carrying design lateral loads, the post 10 should have sufficient hardness at its foot 12 to cut through a soil matrix 14 it is driven into without significant physical deformation. To advance this goal, a post-drive shoe 16 that reinforces and protects the post's matrix material during handling and driving is provided at the foot 12 of the post 10. The post-drive shoe 16 can be cast in the mold and/or attached after the post 10 is molded. FIG. 2 provides a cross-sectional view looking down at the same post 10 and guardrail 11 and also illustrating sheet steel reinforcements 18 proximate the tensile face 20 of the post 10 and a post-bolt 22 passing through the post 10 and securing the guardrail 11 to the post 10. A spacer-block can be provided between the guardrail 11 and post 10, with the post-bolt 22 likewise passing through the spacer-block.

The sheet steel 18 can extend down, then across the post's foot 12 and may then extend back up a certain length of the compressive face 24 or back of the post 10. The sheet steel 18 can also extend up, then across the post's top 26 and/or extend down the compressive face 24 of the post 10. The sheet steel 18 can also extend down farther to include and reinforce the post-bolt hole. In fact, in the event that the polymer 28 in question lacks sufficient compressive strength, the post 10 is preferably designed with sheet steel 18 extending completely around the post 10, with or without identical sheet steel thicknesses at various locations. In the event that the polymer 28 in question lacks shear strength, banding can be applied. Actual compositing of the sheet steel 18 to the polymer 28 can be by way of pressure and/or heat forcing the polymer 28 into and/or through the sheet steel 18 perforations, thus assuring good shear transfer. Another means and method is to partly or completely encapsulate the sheet steel 18 by applying a layer of polymer 28 over the exposed side(s) of the sheet steel and apply pressure and/or heat to melt the two plastic surfaces into one through the sheet steel perforations. Similar approaches use fiberglass and/or carbon fiber, either individually and/or combined and/or in concert with sheet steel.

Other examples of laterally-loaded foundation piles of this invention include permanent retaining walls, permanent sea walls and temporary trench walls. Each includes the polymer matrix and reinforcement material mounted proximately to the tensile face of the pile, as described above. Further, in each case, the tensile face of the post is the face that is put in tension when an intended lateral load is applied. E.g., where the post is part of a retaining wall, the tensile face is the face that is proximate to the retained mass.

Laterally loaded shallow foundation piles, such as permanent retaining walls, permanent sea walls, temporary trench walls and highway guardrail posts tend to be designed as cantilevers. That is, one end of the pile or post is considered "fixed" in a Ad support matrix (e.g., soil) and the other end is "not-fixed"; the "not-fixed" end is allowed to deflect when under design loadings. In the case of a retaining wall, the design load is usually applied over the length of the pile with higher design loadings at the pile's "fixed" end. The design load usually tapers off as one moves toward the "not-fixed" end of the pile. In the case of a "strong-post" guardrail system, the design load is usually a "point-load" applied via the W-beam rail, through the "spacer-block" to the "not-fixed" end (in normal guardrail applications the "not-fixed" end is the top of the post).

In any of these case loadings, or similar loadings, the face of the pile or post facing toward the loadings tend to be in tension when under design loads. The opposite face of the pile or post tends to be in compression when design loads are applied. To maintain structural integrity, the pile or post transfers shear between the opposing faces (tensile/compression) without change in distance between the faces. Use of polymer usually provides significant compressive strength but not tensile strength. The placement of reinforcement, such as sheet steel and/or strands of fiberglass and/or carbon fiber in a tensile region of the post and/or attached to the pile's or post's tensile face redresses the lack of tensile strength in the polymer. An important structural issue is establishing a bond between the tensile face and the compressive face via shear transfer from the tensile face material and the polymer matrix of the pile's or post's material. Gluing is an option when the polymer is of sufficient shear strength and both the tensile face material and the polymer are compatible for gluing. If the polymer is not of sufficient shear strength and/or if a chemical bond, such as that formed by gluing, is not practical, and/or if there is incompatibility of materials for chemical bonding between the reinforcement and the polymer, the physical shear connection is provided either by extending the reinforcement into the polymer to a depth compatible with shear transfer requirements or by extending the polymer into and/or encapsulating all or part of the reinforcement. Alternatively, the fibers can be applied to a preform tensile face, which is then put in an injection mold where another polymer layer is molded on top of the fibers.

Figure 3:
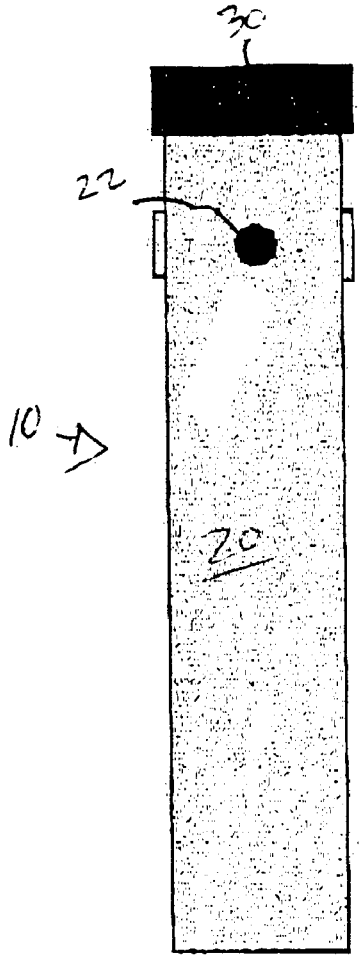
FIG. 3 is a view of the tensile face of a foundation post of this invention.
Figure 4:
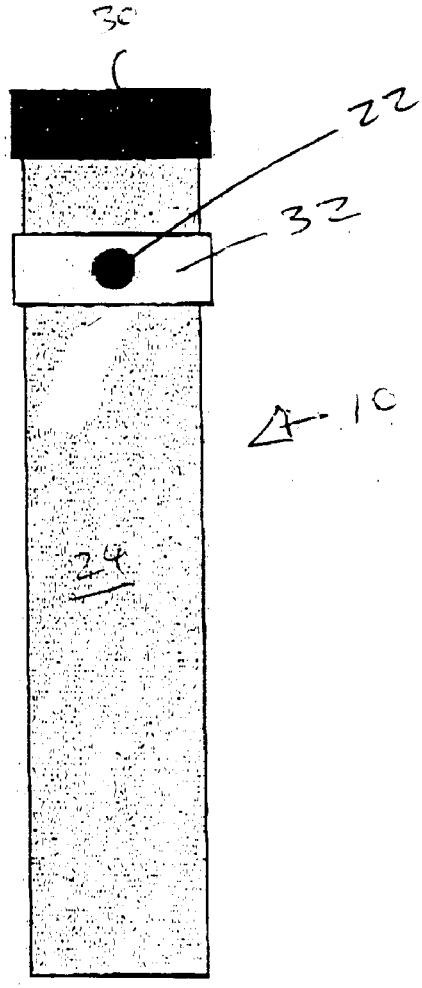
FIG. 4 is a view of the compressive face of a foundation post of this invention.

FIGS. 3 and 4 respectively illustrate a view of the front, or tensile, lateral-load bearing face 20 of the post 10 and a view of the back, or compressive, face 24 of the post 10. FIGS. 3 and 4 also illustrate a post crown 30 formed of steel or carbon cloth and including a band wrapping around the top end of the post 10 for reinforcing the post 10 both for pile-driving activities, discussed below, and also for torque resistance to a lateral load (e.g., a vehicle impact). The post crown 30 can also include a top cover. If a standard spacer block is positioned between the post 10 and a guardrail secured to the post 10, the tensile-face side of the post-crown band can be eliminated to accommodate placement of the spacer block flush with the post 10; in which case, the post crown 30 acts to resist rotation of the spacer block during, e.g., a vehicle impact. Further, the post crown 30 can be cast in the mold and/or attached after the post 10 is molded.

FIG. 4 also illustrates post-bolt reinforcement strip 32 that may be cast in the mold and/or attached after the post 10 is molded. The strip 32 can wrap completely around the post 10 if a spacer block is not used. If the strip 32 is attached after the post 10 is molded and spacer block is to be used, then the spacer block can be modified to accommodate the reinforcement strip 32.

Figure 5:
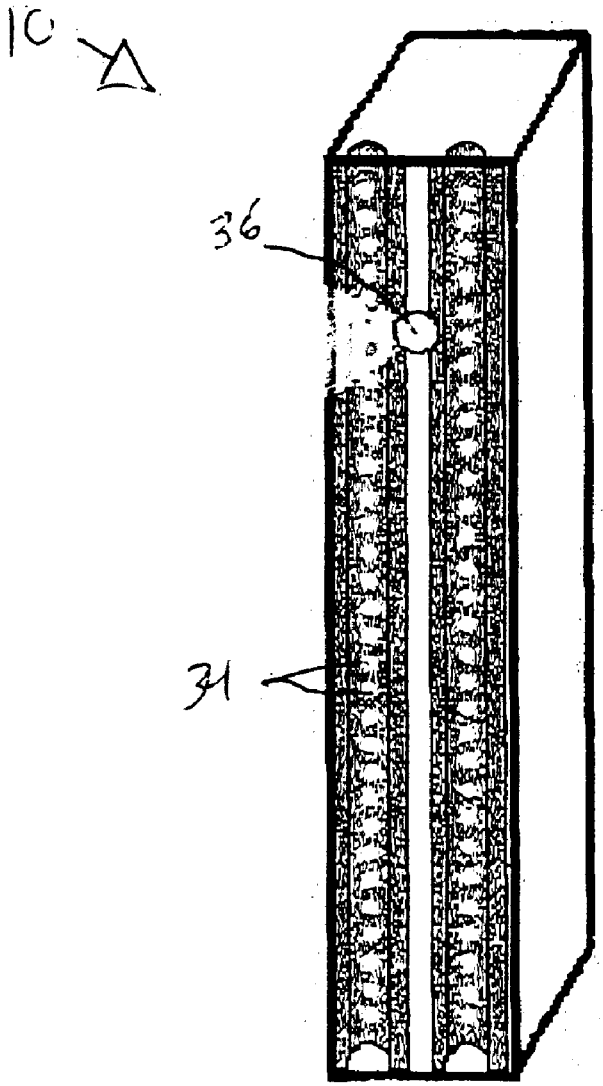
FIG. 5 is a cross-sectional view into the tensile region of a foundation post of his invention with sheet-steel U-channel reinforcements exposed.

In FIG. 5, a cross-sectional view of a post 10 of this invention is provided, looking at a pair of perforated sheet-steel, U-channel reinforcements 18 embedded in the tensile region of the post 10, proximate the tensile face of the post 10. The reinforcements 18 preferably run the entire length of the post 10. The perforations 34 in the steel provide for polymer flow process and to provide shear transfer and/or to attach shear studs. The bolt hole 36 can be cast in the polymer or bored out of the polymer after casting. The hole 36 can be made with or without making contact with the reinforcement 18.

Figure 6:
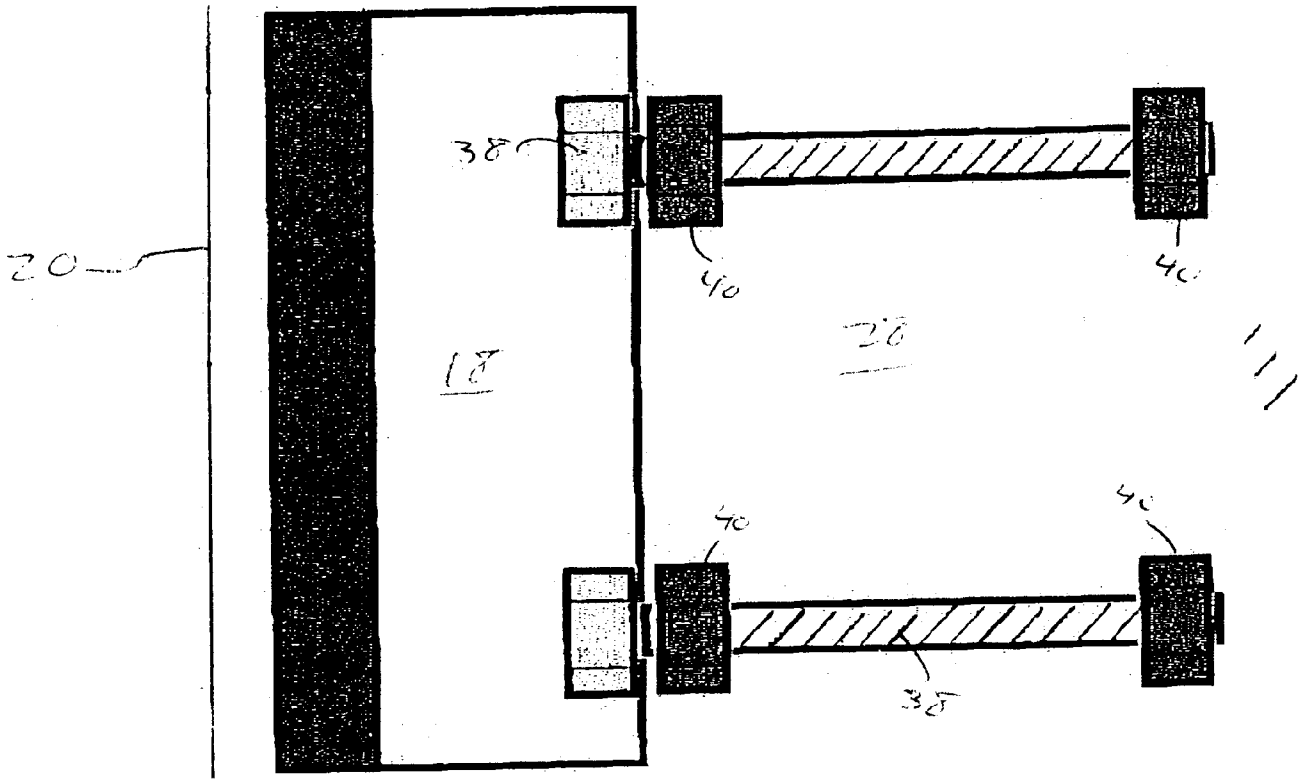
FIG. 6 is an exposed view of shear studs in a post of this invention.

Shear studs, in the form of bolts 38 with nuts 40 are passed through the U-channel sheet steel reinforcement 18 in FIG. 6. The bolts 38 extend through the polymer 28 to resist shear stress in the post 10 and to prevent delamination at the interface of the sheet steel 18 and the polymer 28 when a lateral load is applied.

Figure 7:
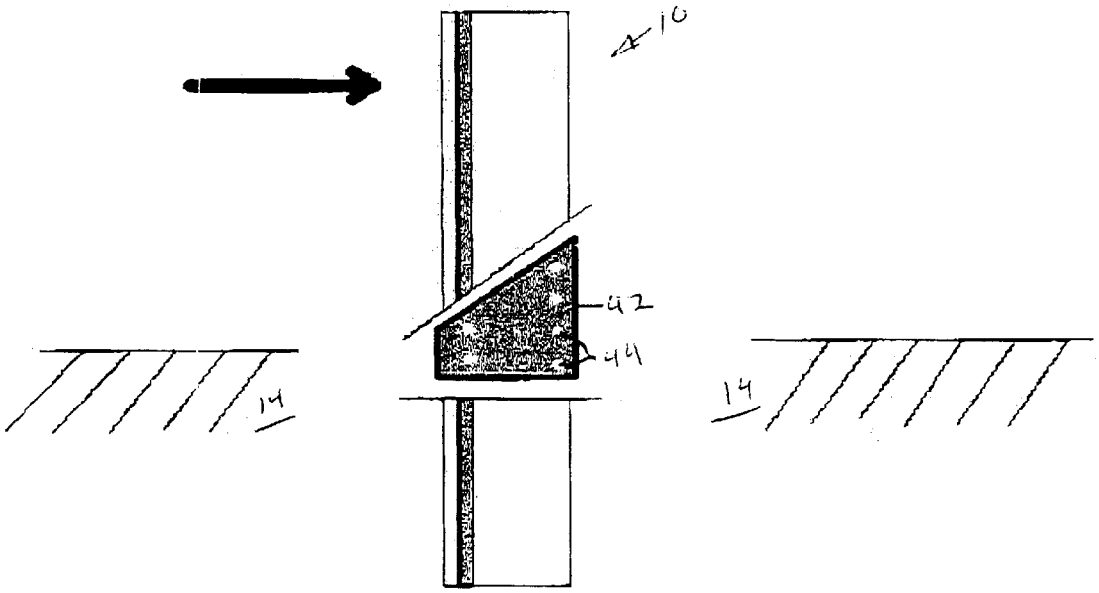
FIG. 7 is an exploded view of a foundation post of this invention including a girdle.

As shown in FIG. 7, which is cut away to show relative placement, a girdle 42 can be provided at ground 14 level to provide additional lateral support for the post 10. The girdle 42 can be placed inside the mold or attached after the post 10 is formed. Holes 44 are provided in the girdle 42 to provide for polymer flow process and to provide shear transfer and/or to attach shear studs. In alternative embodiments, bonding around other parts or all of the post between the ground and a spacer block to supply additional lateral support.

The pile's or posts lateral resistance should not exceed the soil matrix's lateral resistance to the design loads in question. That is, failure of the soil matrix to resist the design lateral loadings is usually a result of either inferior soil conditions for the design loads in question, or failure of the pile's or post's compressive face to fully develop the strength of the soil matrix due to less than optimal "spade" dimension aspects of the pile or post. Failure of the soil matrix in contact with the pile's or post's tensile face should be considered but is usually rare in short piles.

In addition to the requirement that the pile's or post's foot retain its structural shape during its installation of being driven through the soil matrix in question, the pile's or post's top must also retain its structural integrity to as to fully develop the load transfer from the system's spacer-block. Retaining the structural integrity of the post's top through the driving operation of placing the post to the appropriate depth into the soil matrix can be achieved by one or both of the following. First, a drive-cap can be temporarily placed of the top of the post, thereby distributing more evenly the vertically applied driving force of the drop-hammer. Second, the top of the post can be specifically reinforced or banded around the top and/or extended down the sides.

While this invention has been particularly shown and described with references to preferred embodiments thereof, it will be understood by those skilled in the art that various changes in form and details may be made therein without departing from the scope of the invention encompassed by the appended claims.

What is claimed is:

1. A composite foundation post comprising a polymer matrix having a tensile region and a compressive region, and a reinforcement in or attached to the tensile region of the polymer matrix, wherein the close proximity of the reinforcement to the tensile region of the post allows for the transfer of shear stress from the tensile region to the reinforcement, wherein the reinforcement is sheet steel.

2. The foundation post of claim 1, wherein the sheet steel is in the form of a perforated U-Channel.

3. The foundation post of claim 1, wherein the reinforcement includes fiber and has perforations for receiving said polymer matrix, wherein shear stress is transferred to said reinforcement.

4. The foundation post of claim 3, wherein the fiber is fiberglass.

5. The foundation post of claim 4, wherein the fiber is carbon fiber.

6. The foundation post of claim 1, wherein the foundation post has a ground-level base and a girdle is wrapped around the ground-level base.

7. The foundation post of claim 1, wherein the foundation post includes a post-drive shoe for positioning and reinforcing a bottom of the post during driving.

8. The foundation post of claim 1, wherein the foundation post include a post crown for reinforcing the post.

9. The foundation post of claim 1, further comprising a guardrail secured to the foundation post proximate the tensile region of the post.

10. The foundation post of claim 9, wherein the foundation post is anchored in a support matrix.

11. A method for driving a composite foundation post comprising:

placing a driving cap over a top end of a composite foundation post to more evenly distribute a driving force to the top end of the post; and applying a drive force to the drive cap to drive the post into a support matrix;

wherein the composite foundation post is reinforced with sheet steel in the form of a perforated U-channel.

12. A method for driving a composite foundation post comprising:

reinforcing the exterior of a composite foundation post; and applying a driving force to the composite foundation post to drive the composite foundation post into a support matrix;

wherein the reinforcing of the exterior of the composite foundation post strengthens the post as it is being driven into the support matrix.

13. The method of claim 12, wherein the exterior of the post is reinforced by wrapping a support band around a top end of the post.

14. The method of claim 12, wherein the exterior of the post is reinforced by extending a support band along sides of the post extending between a top end and a bottom end of the post.

15. A composite foundation post comprising a polymer matrix having a tensile region and a compressive region, and a reinforcement in or attached to the tensile region of the polymer matrix, wherein the reinforcement is a steel sheet in the form of a perforated U-channel.

* * * * *